United States Patent [19]

Vogel et al.

[11] Patent Number: 5,014,756

[45] Date of Patent: May 14, 1991

[54] PILE WARP TENSION CONTROL IN A LOOM

[75] Inventors: Rudolf Vogel, Grut; Anton Ruedisueli, Ruti, both of Switzerland

[73] Assignee: Sulzer Brothers Limited, Winterthur, Switzerland

[21] Appl. No.: 372,325

[22] Filed: Jun. 28, 1989

[30] Foreign Application Priority Data

Jul. 8, 1988 [CH] Switzerland ..... 02623/88

[51] Int. Cl.[5] ..... D03D 49/12

[52] U.S. Cl. ..... 139/97; 139/102; 139/114

[58] Field of Search ..... 318/603; 139/97, 103, 139/109, 102, 110, 114; 310/266; 73/619

[56] References Cited

U.S. PATENT DOCUMENTS

| | | | |
|---|---|---|---|
| 4,106,492 | 8/1978 | Schuett et al. | 73/619 X |
| 4,350,941 | 9/1982 | McClure et al. | 318/603 |
| 4,554,472 | 11/1985 | Kumantani | 310/266 X |
| 4,554,951 | 11/1985 | Hirano et al. | 139/110 |
| 4,569,373 | 2/1986 | Vogel | 139/25 |
| 4,750,527 | 6/1988 | Rehling | 139/110 |
| 4,827,985 | 5/1989 | Sugita et al. | 139/25 |

FOREIGN PATENT DOCUMENTS

| | | |
|---|---|---|
| 0080581 | 6/1983 | European Pat. Off. . |
| 0109472 | 5/1984 | European Pat. Off. . |
| 0136389 | 4/1985 | European Pat. Off. . |
| 3532798 | 4/1986 | Fed. Rep. of Germany . |
| 2419989 | 10/1979 | France . |
| 472521 | 6/1969 | Switzerland . |

*Primary Examiner*—Andrew M. Falik
*Attorney, Agent, or Firm*—Kenyon & Kenyon

[57] ABSTRACT

To operate the loom, one or more warp-tensioning elements is or are actuated by separate drives on an individual pick basis with free triggering and at loom speed. The warp tension can therefore be so modulated as to obviate deleterious tension peaks and warp breakages and overflow tensions. The loom has at least one servomotor. A servomotor, which is triggered by a control and adjustment circuit arrangement, drives the warp-tensioning element by way of a reduction transmission and transmission elements. The servomotor can be commutated preferably brushlessly and electronically and have a low mass inertia rotor and high-field-strength permanent magnets.

26 Claims, 8 Drawing Sheets

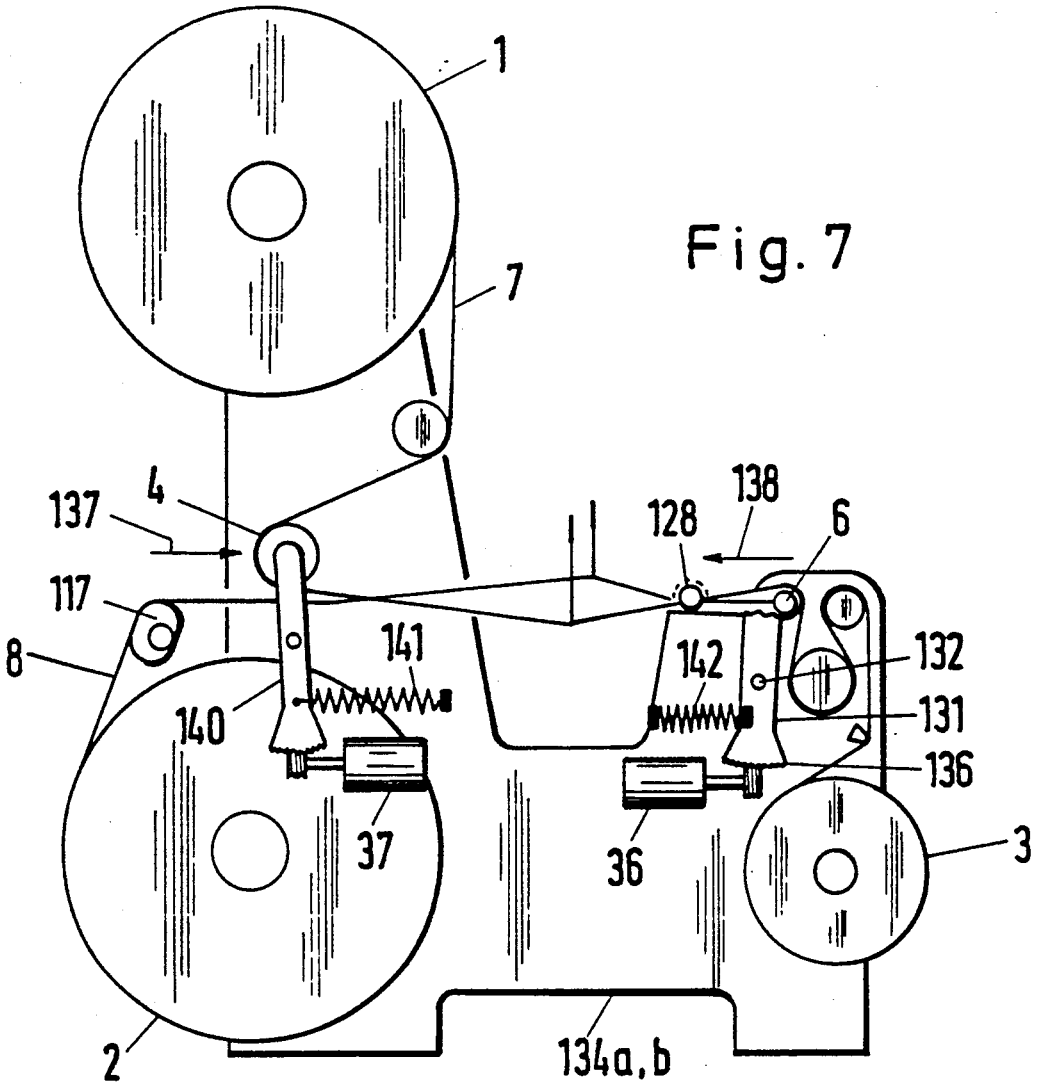
Fig. 7
Fig. 8
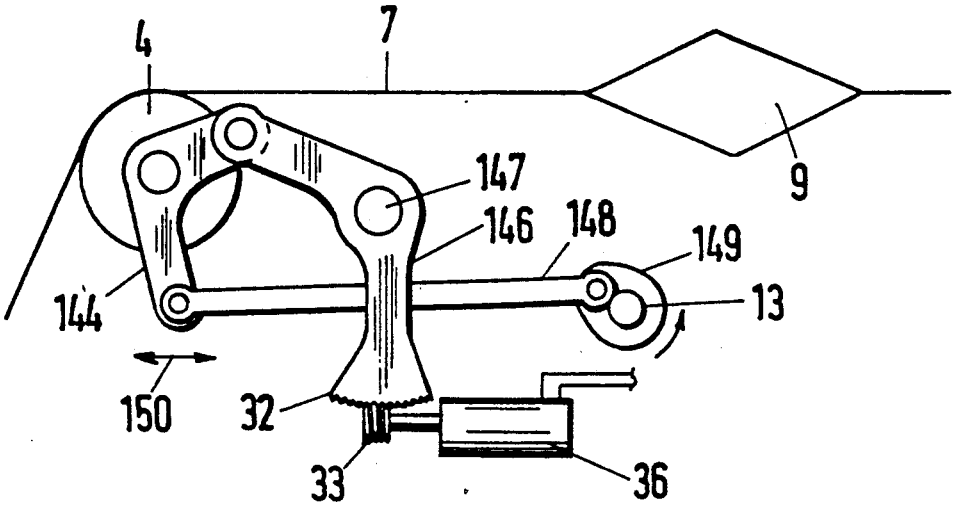

PILE WARP TENSION CONTROL IN A LOOM

This invention relates to a method of controlling warp tension in a loom and to a loom having a warp tensioning element.

The basic importance of warp tensioning in weaving is discussed in detail, for example, in a lecture given by S. Schlichter at Aachen in 1987 entitled "Der Einfluss der einzelnen Maschinenelemente auf die Bewegungs- und Kraftverlaufe in Kette und Schuss an Hochleistungswebmachinen". It is essential to have "good" timing of warp tensioning if the end-product fabrics are to be satisfactory. This means that warp tensioning must be sufficient to ensure firm textures at beating-up and to ensure at all times that loose yarns do not cling together. However, specific peak values for the yarn being processed must never be exceeded anywhere if weft breakages are to be avoided. Cloth and texture quality, profit and loom output are largely dependent on warp tensioning. This is determined by various factors:

Cyclic influences arising from shed changing and beating-up and depending on weaving cycles and the repeats of weave and patterning;

Sporadic effects such as relaxation effects at stoppage and staring of the loom, and Continuous effects, for example, related to the paying-off of the warp beam.

Passive sprung whip roll systems have conventionally been used to ensure the required form of warp tensioning and there has been some disclosures, for example, in U.S. Pat. No. 3,483,897, of whip rolls which have a mechanically rigid connection to the loom main drive.

Various improvements have been suggested to satisfy at least some aspects of the rising requirements associated with high-speed looms. For example, EP-PS 0 109 472 suggests a low-mass whip roll system in order to reduce detrimental phase shifts while DE-PS 3 532 798 discloses a warp yarn tension control based on the displacement of a back rail as a means of obviating start zones. The same intention is behind controlled warp let-off systems, such as disclosed by EP-PS 0 136 389. However, all these known suggestions provide only partial and very limited improvements.

Accordingly, it is an object of the invention to provide optimal warp-tensioning patterns in all circumstances of a loom operation and in any desired patternings.

It is another object of the invention to achieve higher loom speed and performances by controlling the warp tension.

It is another object of the invention to improve the fabric quality of a woven fabric in a loom.

It is another object of the invention to control the warp tension in a loom with minimal interruptions in production due to yarn breakages and loose yarns clinging together.

It is another object of the invention to permit a wide range of possible patterns in weaving on a loom.

Briefly, the invention provides a method of operating a loom wherein warp tension is modulated by at least one separate drive by way of warp-tensioning elements and triggered for individual picks and freely i.e. independently of other drives of the loom. Warp tensioning can therefore be optimally adapted to all required circumstances in an individual cycle.

Advantageously, the separate drive can be triggered by a sequence of pulses whose amplitude, pulse width, zero position and phase relationship are freely programmable and which are adapted to loom cycles and the nature of loom operation.

If the pulses are triggered with a duration shorter than a single loom cycle, warp tensioning can be directly affected just in a required sub-zone of a cycle. If one pulse each is triggered in a number of sub-zones of a weaving cycle or of a weft repeat, warp tension can be correspondingly directly optimized in the discrete sub-zones, the pulses being triggerable independently of one another.

The production of compensating pulses in those sub-zones of the loom cycles in which warp tensioning peaks occur can reduce such peaks, for example, below an adjustable set value corresponding to yarn strength. This feature greatly reduces warp breakages, which are a main cause of interruptions in production, and correspondingly increase profits. Similarly, minimal values can be produced in zones to prevent the warp tension from undershooting an adjustable set value, for example, a value below which the tendency of the warp yarns to cling together becomes excessive.

In the operation of a terry cloth loom having pile-forming elements, in addition to the warp tension modulation at least one pile-forming element can be actuated by another separate drive and triggered for individual picks and freely. This feature helps to improve terry-cloth weaving and pile quality.

A loom for performing the method is distinguished by at least one servomotor as a separate drive coupled by way of a reduction transmission and/or transmission elements with at least one warp-tensioning element affecting warp tension. The servomotor is connected by way of a control and adjustment facility to a control input and is triggerable for individual picks and freely. Preferably, the servomotor can be electronically commutated and brushless and have a rotor of low mass moment of inertia and high-field-strength permanent magnets. This construction provides a particularly highly dynamic drive giving high peak and continuous power at relatively low heat dissipation values. The method according to the invention can therefore be performed very accurately and at high speeds and outputs.

Other advantageous constructions can have servomotors having rare earth magnets and more particularly magnets made of Nd-Fe-B compounds. The very high field strengths of these magnets both in absolute terms and as to their weight lead to very high motor power and loom speeds. Power can be further increased in a simple manner by cooling the stator of the servomotor.

The loom can have as many triggered warp-tensioning elements as required. The warp tensioning element can be, for example, an additional whip roll driven only by the associated servomotor. Alternatively, the warp-tensioning element can be an existing whip roll system which is driven in a basic movement by the loom main motor and the basic movement can be subjected only to additional modulation and control by the servomotor. The constant basic movement can therefore provide a constant shed compensation or equalization while the servomodulation optimizes all the changing conditions, for example, in accordance with patterning. Warp tensioning elements on both side uprights of a loom can be driven symmetrically by an associated servomotor, the two servomotors preferably being driven and controlled synchronously by just a single motor control. This ensures completely symmetrical fabrics even in the case of substantial cloth widths.

The high dynamics of the servomotor can be transmitted as far as the warp-tensioning element by a reduction transmission which has a low mass inertial primary element on the motor shaft.

A number of control inputs, measurement inputs and/or data outputs of the control and adjustment facility and an associated computer unit can be provided, two-way communication with the loom being possible. This feature provides an even more universal control and adjustment of the pattern of warp tensioning and also enables operating data to be prepared and delivered for further processing and for optimization of cloth quality, loom performance and profit.

In the case of looms having at least two warp yarn sheets, each such sheet can have an associated warp-tensioning element with an associated servomotor; the servomotors being triggerable independently of one another. This feature enables the warp-tensioning pattern of each warp yarn sheet to be optimized individually.

Theoretically, a number of warp-tensioning elements each having one or two servomotors can be triggered independently by the same control and adjustment circuit arrangement so that each such element can be given an optimal individual adjustment to suit the required weaving result.

In the case of a terry cloth loom, in addition to the warp-tensioning element and the servo-drive, at least one pile-forming element can have an associated further servomotor whose triggering is adapted to pile formation. This feature provides additional control and optimization of pile formation.

These and other objects and advantages of the invention will become more apparent from the following detailed description taken in conjunction with the accompanying drawings wherein.

Figure 4:
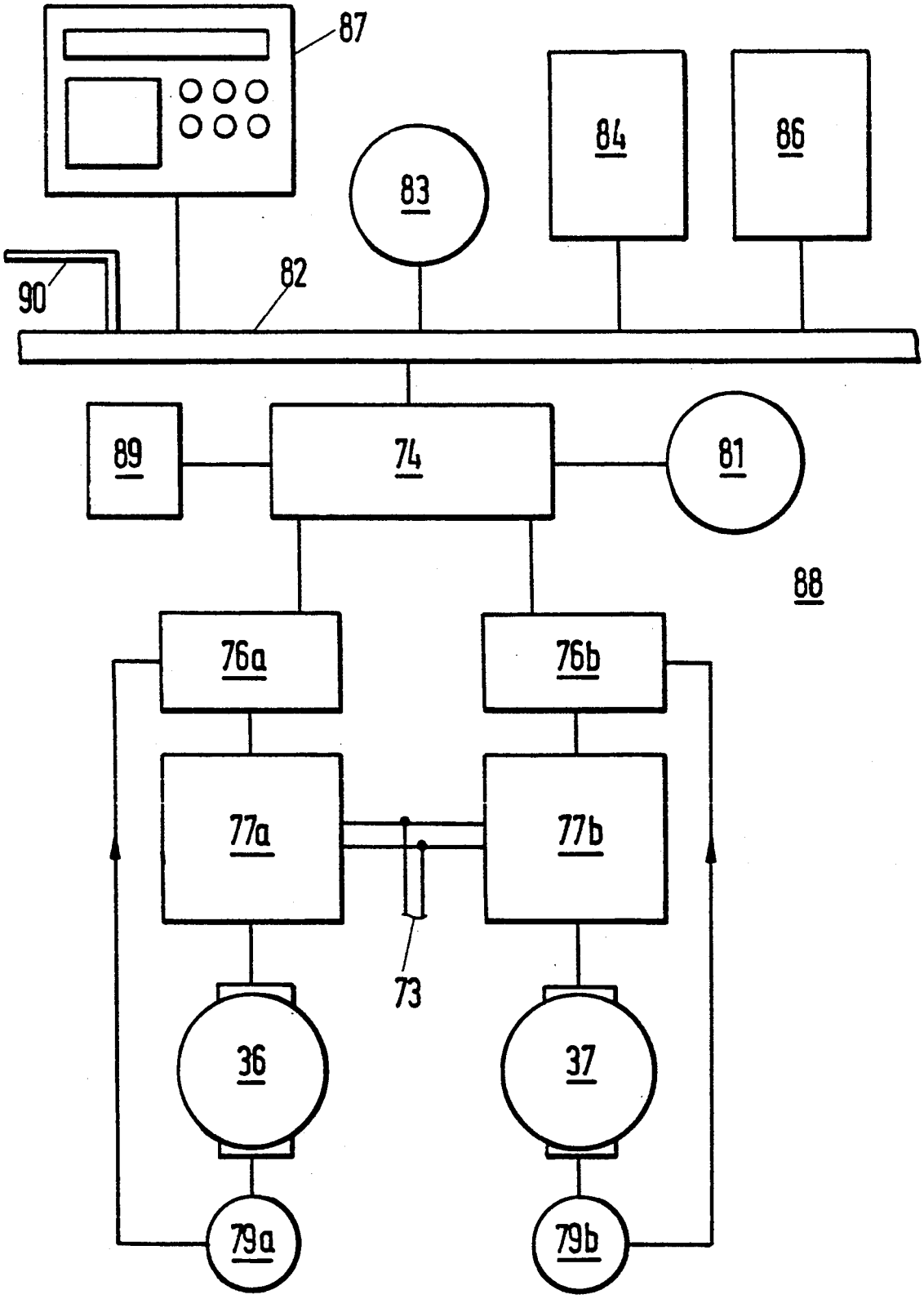
Figure 5:
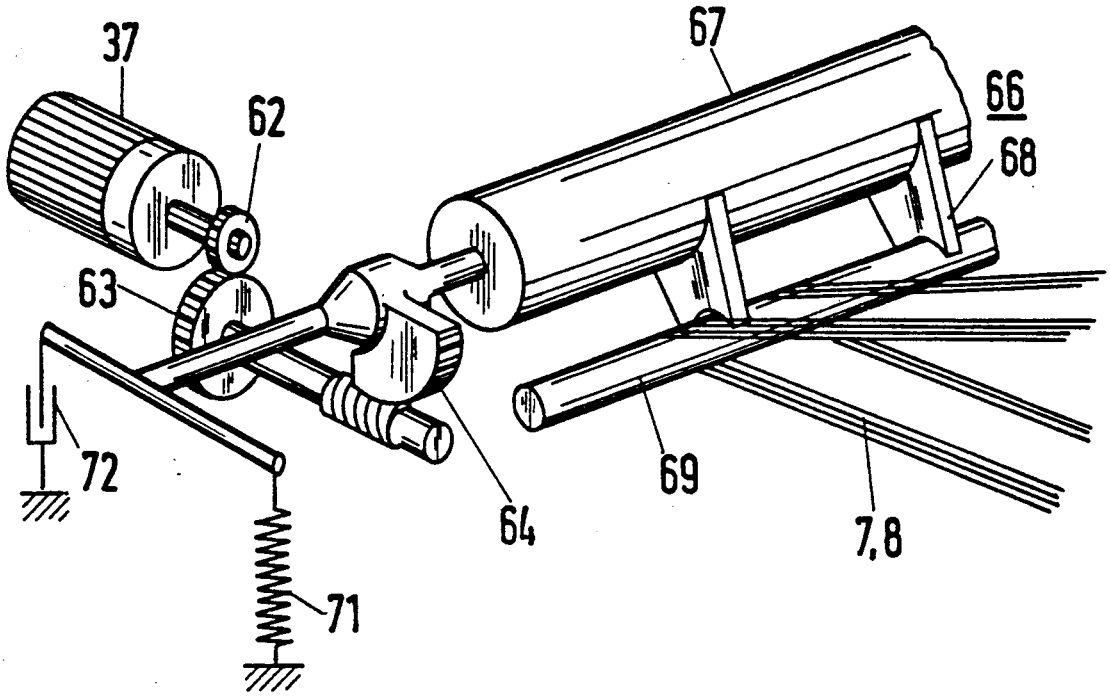

FIG. 3*a*–3*d* show various arrangements of warp-tensioning elements;

FIG. 4 is a block schematic diagram of a loom according to the invention having a control and adjustment circuit arrangement;

FIG. 5 illustrates a servo-operated low-mass whip roll in accordance with the invention;

FIGS. 6*a*–6*e* show examples of warp tension patterns and controlled warp-tensioning pulses;

FIG. 7 shows a terry-towelling loom having two warp beams and servo control, and FIG. 8 shows an example of a warp tension control having a constant basic movement and servo modulation.

Figure 1:
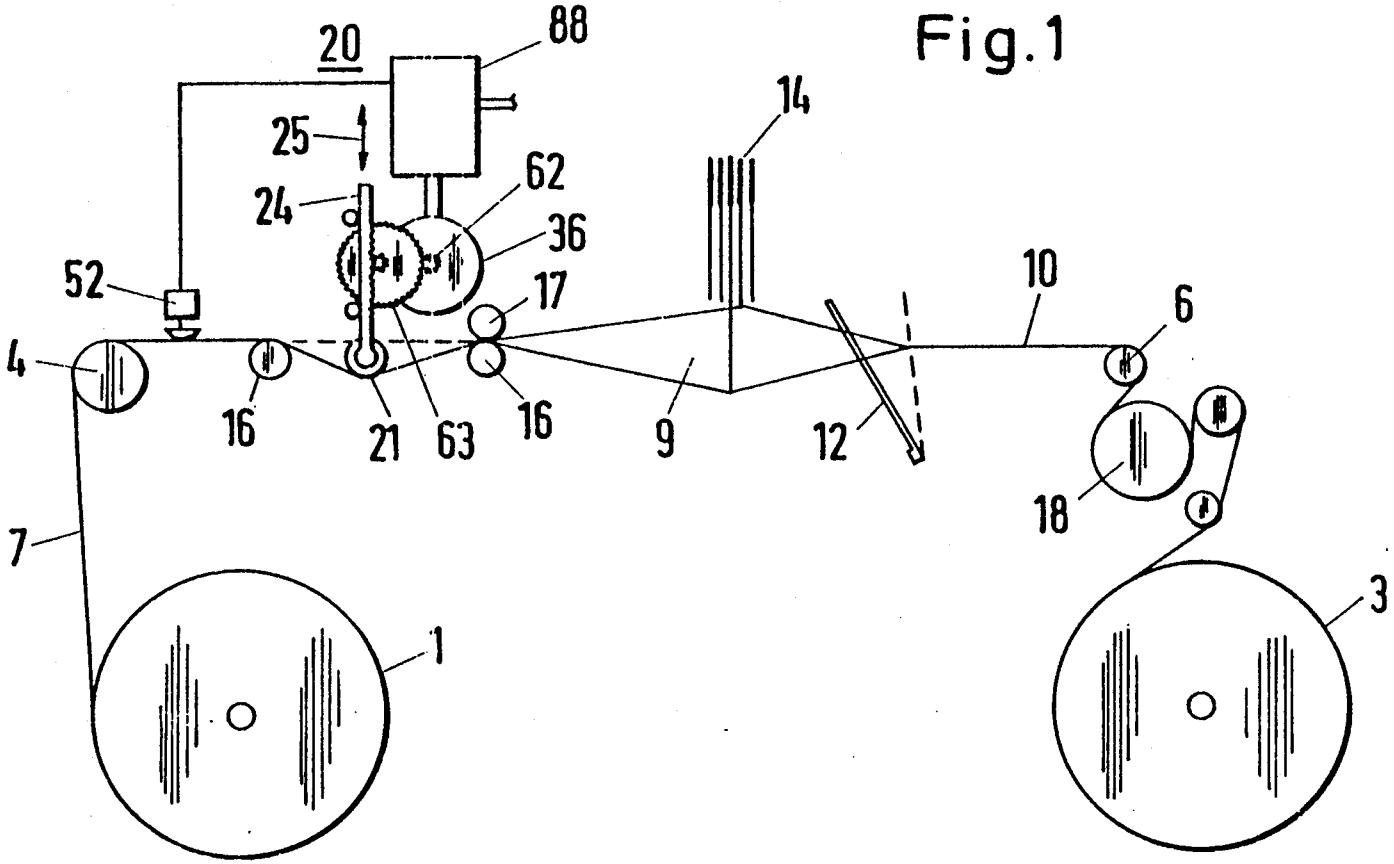
FIG. 1 illustrates a loom according to the invention having warp tensioning control.

Referring to FIG. 1, the loom has a warp tension control wherein warp 7 runs off a warp beam 1 over a whip roll 4 to a shed 9 having heald frames 14 and a reed 12. Cloth 10 is taken off by way of a breast beam 6 and a take-off roller 18 onto a cloth beam 3. A warp-tensioning control 20 comprises a warp-tensioning element in the form of a roller 21, a toothed rack 24 as transmission element, a reduction stage (gear) 63, a pinion 62 on the shaft of a servomotor 36 and a control and adjustment circuit arrangement 88. The roller 21 can be vertically reciprocated in the direction indicated by a double arrow 25 at any required rhythm by triggering of the servomotor 36. The reciprocation of the roll 21 lengthens or shortens the warp 7 and therefore varies the tensioning therefore in a manner determined by the elasticity of the yarn. Theoretically, therefore, any required variation in warp length —i.e., any required pattern of warp tension—can be produced by an appropriately timed triggering of the servomotor 36. A warp tension detector 52 connected to the circuit arrangement 88 provides continuous monitoring of the resulting warp tension by generating a signal in response thereto and this factor is included in the optimal control of warp tension via control 20 which responds to the signal from the detector 32.

More particularly, the alteration in warp length caused by shed changing can be compensated for partly or wholly by the control 20. In amplification of existing whip roll systems, the control 20 is able to act on warp tension even when the known whip roll systems become increasingly unable, as speeds increase, to provide anything like an optimal pattern of warp tension. The control 20 can be incorporated in or replace the whip roll system itself, for example, as shown in FIG. 7.

Figure 2:
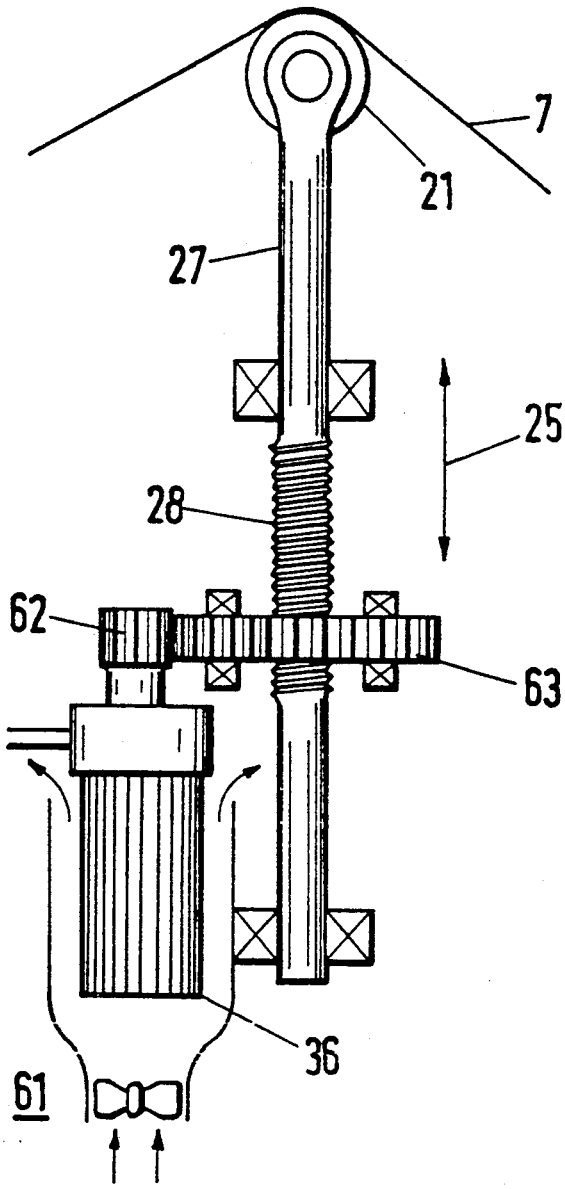
FIG. 2 illustrates a warp-tensioning element having a spindle rod, servomotor and reduction transmission.

FIG. 2 shows a warp tension control having a rotatably mounted spindle rod 27 which produces a vertical linear reciprocation of the warp-tensioning element 21. As illustrated, a servomotor 36 drives a pinion gear 62 which, in turn, drives a pinion 63 threaded on a screwthread 28 on the spindle rod 27. To this end, the pinion 63 has an internal toothing which runs on the spindle screwthread 28 and is supported in has axial bearings in order to withstand the thrust of the warp yarns.

The servomotor 36 has a cooler 61, such as a fan delivering cooling air along a ribbed stator casing of the servomotor in order to serve as a means for cooling the stator.

The servomotor 36 has a low mass inertia rotor having high field strength permanent magnets—i.e., magnets having high remanence and a high demagnetizing field strength. Due to the reduced mass inertia of the rotor, the motor 36 has high dynamics. Further, the high field strength produces high motor torques and outputs, with the overall result being a high loom speed. Rare earth magnets such as SmCo compounds and more particularly Nd-Fe-B compounds are advantageous materials for the magnets. The use of permanent magnets on the servomotor rotor means that ohmic losses arise only on the motor stator and not on its rotor. The heat of dissipation can be removed here readily and substantially, for example, by means of air or water cooling of the stator. This leads to a further increase in servomotor performance with respect to overload peaks, particularly when Neodym magnets are used.

Like the servomotor rotor, the reduction transmission and the transmission elements are constructed to have very reduced losses due to mass inertia. To this end, a two-stage reduction transmission having a lightweight pinion gear 62 on the servomotor spindle is used in FIG. 2. The transmission, which is effective as a low mass inertia primary element, reduces the motor speed abruptly, for example, by a factor of from 3 to 5. In all, therefore, that proportion of motor power which is needed to accelerate the moving parts form the rotor via the reduction transmission and the transmission element to the warp-tensioning elements is very reduced and thus enables the required very high loom speeds to be achieved.

Figure 3D:
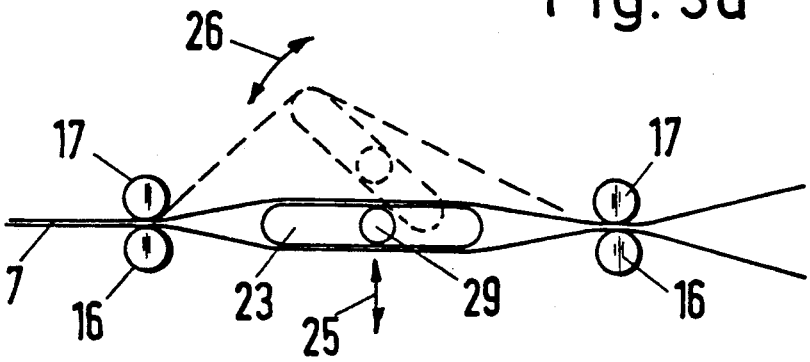
Figure 3A:
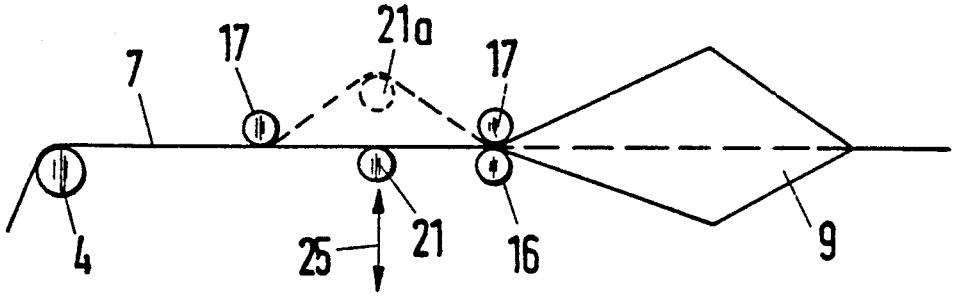

FIGS. 3a–3d show various arrangements of warp-tensioning elements 21–23 having bottom guide rolls 16 and top guide rolls 17, the warp-tensioning elements being movable either by displacement (25) or in rotation (26). As in FIG. 1, the arrangement shown in FIG. 3a is effective symmetrically of the shed 9. All the warp yarns—i.e., the yarn sheets in both the bottom and top sheds—are affected with equal intensity. The sheds are controlled asymmetrically in FIG. 3b. When, depending upon the weave, discrete heald frames remain in the top shed at beating up, the corresponding warp yarn sheets 7h can be relatively detensioned by the warp-tensioning element (in position 22a) while at the same time the other warp yarns 7g are maintained in a necessary minimum tension state by the whip roll 4. For optimum tension control of all the warp yarns 7h and 7g, the whip roll 4 can also be servocontrolled (direction of movement indicated by double arrow 26). However, positions of the warp-tensioning element between 22b and 22c result in a substantially symmetrical control of warp force in the top shed 7h and bottom shed 7t.

Figure 3B:
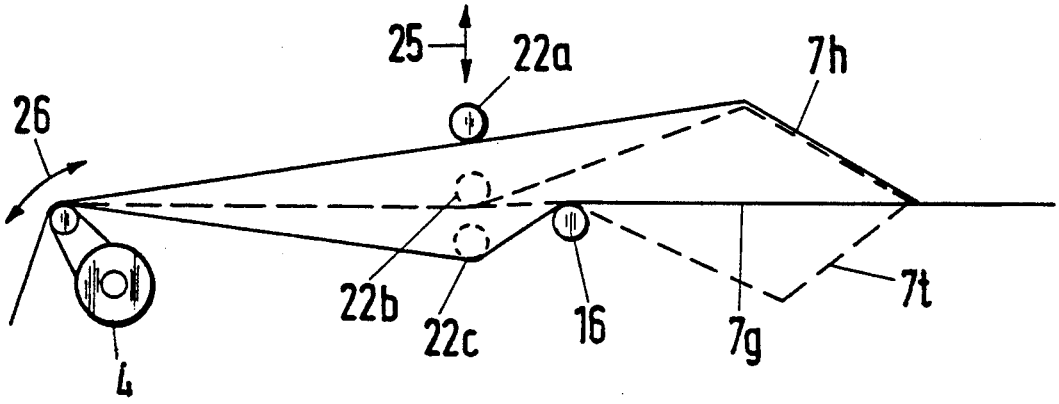
Figure 3C:
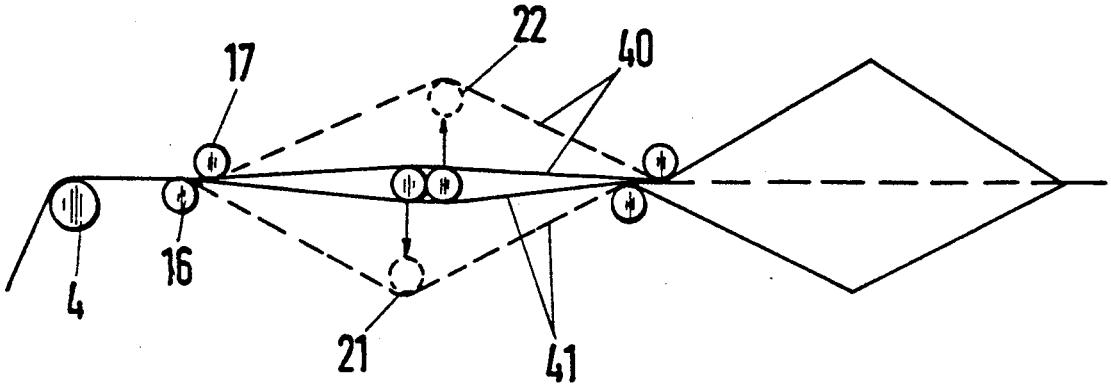

Referring to FIG. 3c, two warp-tensioning elements 21, 22 subdivide the warp yarns into two sheets 40, 41. Consequently, each sheet can be triggered optimally individually and independently of the other sheet by the associated warp-tensioning element and the servomotor thereof. The rocking-beam-like warp-tensioning element 23 of FIG. 3d can provide the same effect. To this end, the element 23 is displaced in the direction 25 by a first servomotor. A second servomotor rotates the element 23 around an axis of rotation 29 in the direction indicated by the arrow 26.

FIG. 4 is a block schematic diagram for the loom. As shown, a control and adjustment circuit arrangement 88 having a control input 89 comprises a terry-toweling tension control 74 which triggers a motor controller 76. The controller 76 drives the servomotor 36 by way of a power pack 77 connected to a supply 73. The controller 76 is connected for synchronization to a motor angle pickup 79. A number of servomotors 36, 37 can be triggered by the warp tension control 74 to actuate a number of warp-tensioning elements independently of one another (76, 77, 79 a and b in each case). Warp yarn deflection and, therefore, tension can therefore be controlled in very small steps of e.g. as little as 0.1 mm.

The control 74 is connected to a loom bus 82 and to a loom crank angle pickup 81 to ensure absolute synchronization of the motor control with the loom for forwards and reverse running. Also, co-ordination with the warp let-off 84, the shedding motion 86 and the other loom functions such as cloth take-off and color changer control proceed by way of the loom bus 82. An indicating and operating unit 87 and various measurement inputs 83, for example, of warp tension pickups, and data outputs 90 are connected to the loom bus 82 to provide two-way communication with the loom. Two-way communication between the weaver and the warp tension control and a link with a central directing system are therefore provided.

The circuit arrangement 88 comprises a computer with memory which is integrated into the operating unit 87. Consequently, an appropriate single-pick-based optimization of warp tension patterns can be generated, stored and called up again for any cloth patternings generated by the shedding motion. A warp tension modulation is associated with each pick of a pattern repeat.

The use of a weft tension detector 52 (FIG. 1) connected to the circuit arrangement 88 enables a required predetermined optimal warp tension pattern to be observed automatically.

FIG. 5 shows a low-mass whip roll system 66 which rotates as warp-tensioning element (like the whip roll 4 of FIG. 3b). A servomotor 37 drives the system 66 by way of a pinion 62, intermediate stage 63 and quadrant 64. The system 66 comprises a rigid top roll 67, a light-weight swinging tube 69 and connecting supports 68. The result is a low mass inertia system 66. An additional adjustable biasing spring 71 and a damper 72 acting on the system 66 can be provided as indicated. The servomotor 37 is triggered by the warp tension control 74 of FIG. 4 but has its own motor control (76b, 77b, 79b). In a terry-towelling loom, a low-mass whip roll system of this kind can be used as pile whip roll or pile vibrator roll.

The function of the swinging pile roll is, during the almost impact-like pushing-up of the pile at full beating-up, to advance the pile warp corresponding abruptly and with a very reduced tension (more particularly in the case of sley control) To this end, the swinging pile roll must be able to move very rapidly and without delay and lightly. However, a minimal pile warp tension must be maintained the rest of the time to ensure undisturbed warp delivery without yarn crossings. Conventional sprung swinging roll systems cannot meet these opposite requirements satisfactorily (FIG. 6e). However, the servomotor-controlled whip roll 66 of FIG. 5 can satisfy these conflicting requirements and trigger optimum warp tension patterns for all kinds of operation and terry-towelling candences.

FIGS. 6a to 6d show patterns of warp tensions F over a number of weaving cycles and weave repeats in dependence upon time:

Warp tension patterns provided by conventional whip roll systems 103, 106–108, 111–114, 124;

Modulated servocontrolled warp-tensioning pulses 100, 104, 109, 116 and

Resulting servocontrolled warp-tensioning patterns 105, 110, 121–123, 125.

Figure 6A:
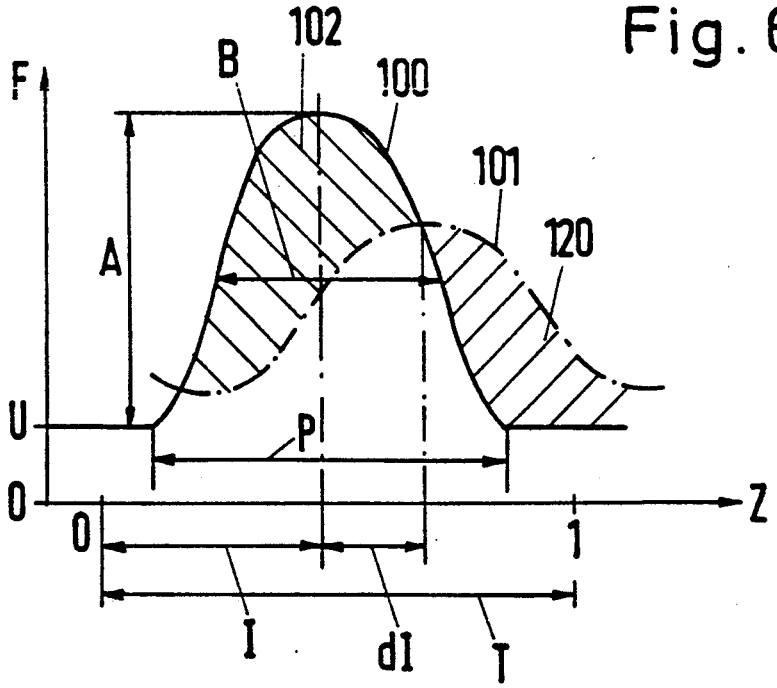

FIG. 6a shows an optimal servo-Controlled warp-tensioning pulse pattern 100 for compensating for a corresponding variation in warp length in response to shed opening. The servomotor so triggers the optimal curve 100 that its amplitude A, pulse width B, zero position U, duration p and phase I correspond in the loom cycle to the set-value compensation. A conventional sprung whip roll system, on the other hand, provides more particularly at high loom speeds only an unsatisfactory "blurred" compensation as indicated by a curve 101. Mass inertia induces a phase shift dI and a reduced amplitude. The conventional compensation provided by the whip roll therefore varies from the optimal pattern 100 by the zones 102, 120, a warp tension which is increased by the zone 102 being initially produced when the high-inertia whip roll cannot follow shed movement, whereafter the whip roll overshoots with an unwanted detensioning of the warp yarns corresponding to the zone 120.

Figure 6B:
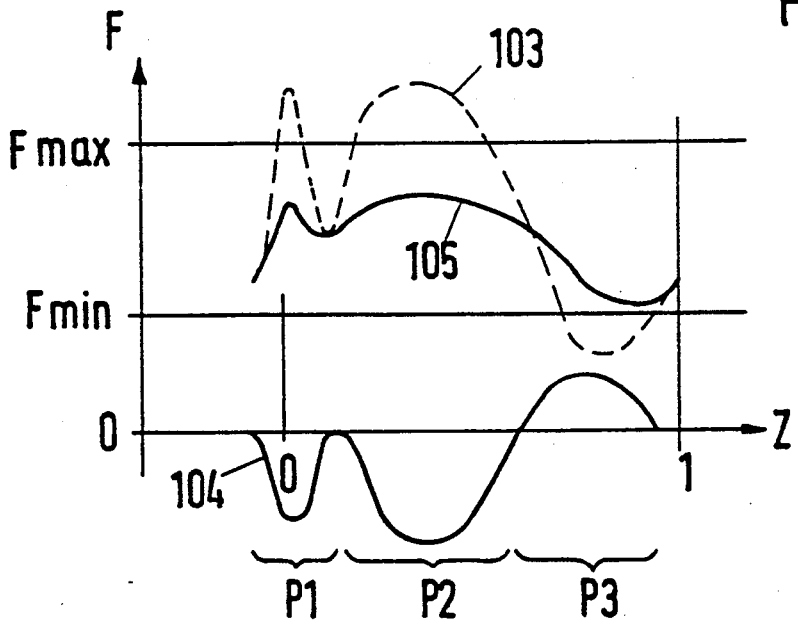

In FIG. 6b, the conventional warp tension pattern 103 is so modulated by a number of servopulses P1, P2, P3 that an optimized warp tension pattern 105 results. The pulses P1, P2 control the pattern 105 to below a predetermined maximum set value Fmax corresponding to yarn strength while the pulse F3 ensures that a predetermined minimal warp tension Fmin is not undershot.

Figure 6C:
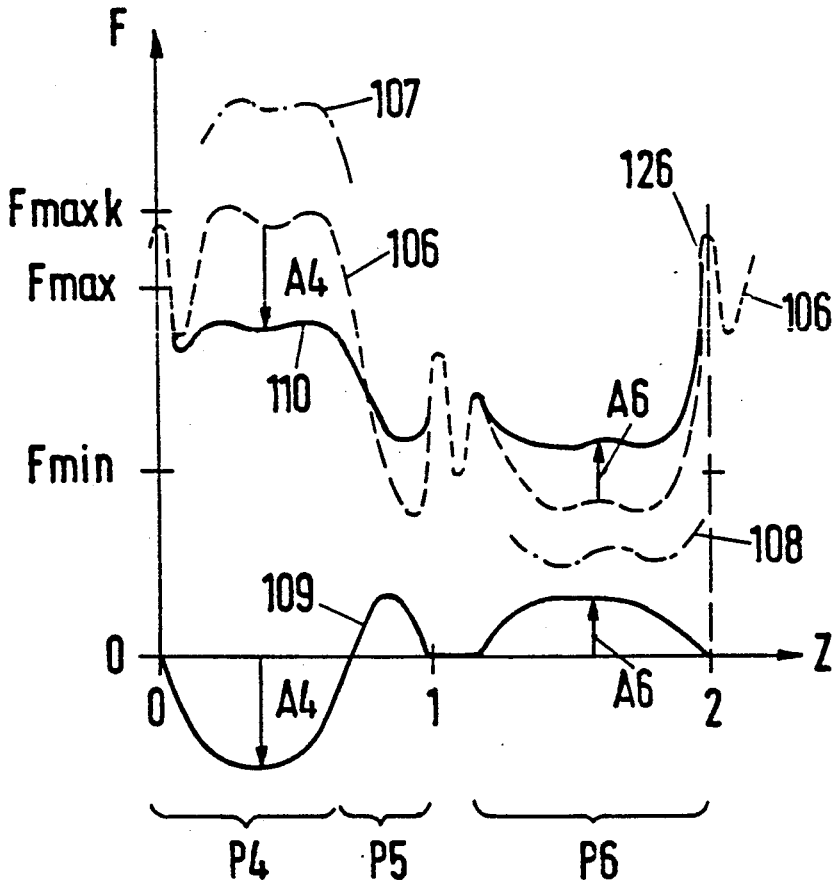

The conventional average warp tension pattern 106 of a warp yarn sheet in FIG. 6*c* shows an example in which in cycle 1 the sheet remains in the top shed at beating-up and therefore experiences substantial tensions, while in the next cycle 2, the shed closes and the warp tension values remain low. The tensions of discrete warp yarns experience higher peak values 107 and lower minimal values 108 than the average warp tension values 106. Individual yarns may therefore tear more rapidly and cling together than would seem likely from the average tension pattern 106. This consideration should be borne in mind when determining the set values Fmax and Fmin. The pulses P4, P5, P6 of the servomodulation 109 are triggered correspondingly in order to produce a required resulting warp tension pattern 110. Another consideration is that higher warp tensions (Fmaxk) are permissible very briefly during beating-up, for example, as tension peaks 107, than for longer periods, for example, in the open shed, compensated for in this case by the pulse P4.

Figure 6D:
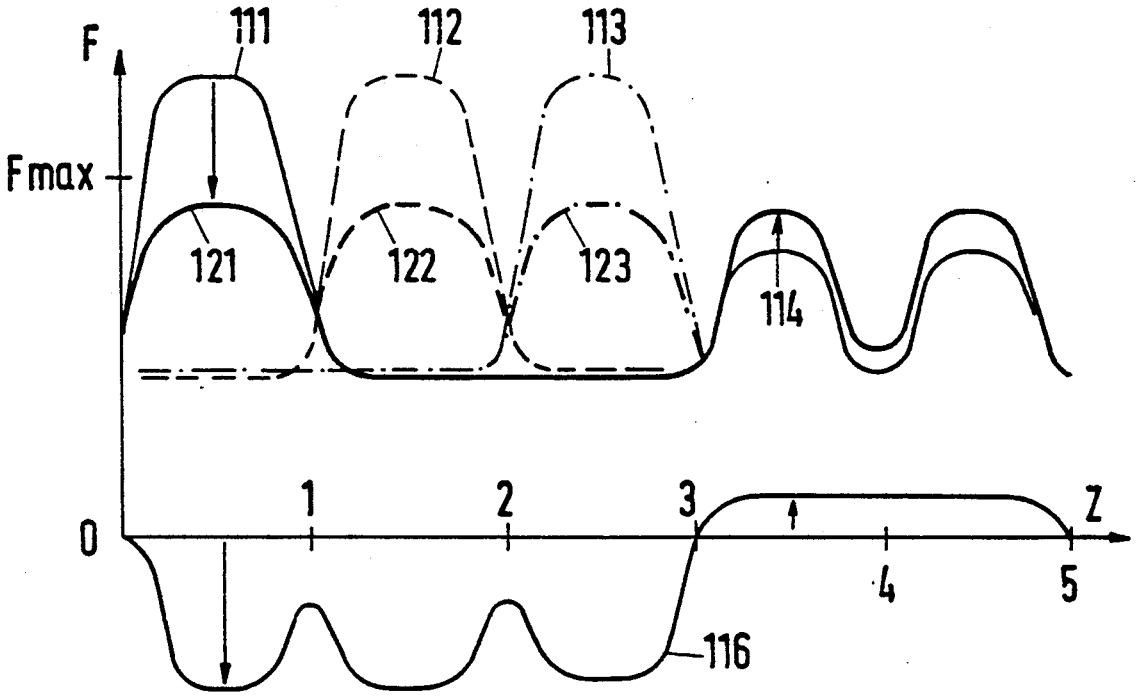
Figure 6E:
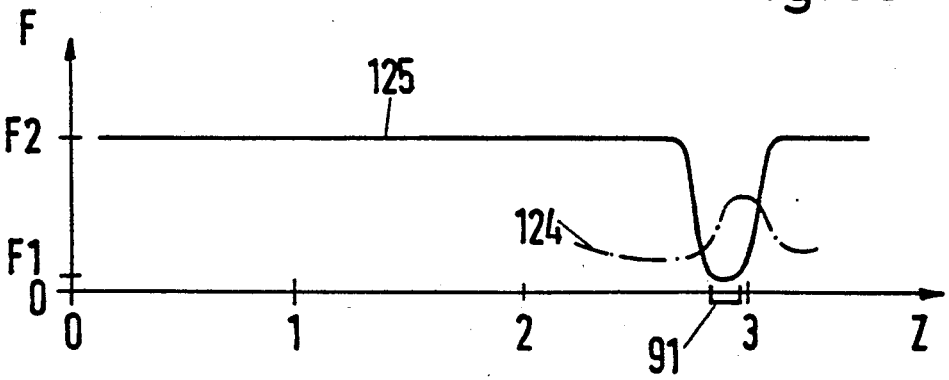

FIG. 6*d* shows a weave change from a 2:1 warp twill weave to a 1:1 plain weave—i.e., first a pick repeat 3 in which one warp sheet always remains alternately in the top shed during beating up and the other two yarn sheets simultaneously close or change. Consequently, the warp tension pattern 111 of the first sheet (in the top shed) has high values in cycle 1 while the tensions of the second and third sheets 112, 113 remain low. Tension pattern 112 is high in cycle 2 and the tension pattern 113 is high in cycle 3. The detensioning servopulses 116 are always applied to whichever sheet is in the top shed, for example, by an arrangement of the warp-tensioning elements in accordance with FIG. 3*b*. The resulting warp tensions 121–123 therefore all remain below Fmax. The change then occurs to a two-pick repeat with two yarn sheets which always close at beating up (each heald frame changes after each pick) and the average warp tension pattern of all the warp yarns is below Fmax. The servmodulation 116 varies correspondingly in cycles 4 and 5, whereafter a 2:1 and a 1:1 weave could follow. This would provide a 5-cycle cloth pattern repeat N.

FIG. 6*e* shows the servo-optimized pattern of a pile warp tension 25 in the case of a three-pick terry-towelling cadence. To this end, a servomotor so triggers a swinging pile roller in accordance with FIG. 5 that an appropriate pulse reduces pile warp tension momentarily to an almost infinitesimal value F1 of a few grams during the pushing-up 91 of the pile. Between the phases 91, the tension rises to a higher and substantially constant value F2 which can be optimally adapted to the yarn and to operating parameters. Whereas the curve 125 produced via the swinging pile roller has an optimal warp force pattern, conventional swinging rollers cannot provide such a pattern, as the curve 124 shows; the minimal force F1 and the optimal phase position and pulse shape as regards the phase 91 cannot be provided on the curve 124.

FIG. 7 shows a terry-towelling loom having a fabric control in which servomotors 36, 37 trigger the fabric-controlling elements which in this case are a whip roll 4 and a breast beam 6 effective as pile-forming elements. The ground warp beam 1 is disposed at the top and the pile warp beam 2 at the bottom for ready replacement. In the control of the fabric, looping is effected by periodic horizontal movements of the cloth produced by means of the breast beam 6 and a temple 128 so that the cloth edge is moved away from the reed beating-up zone by an amount corresponding to cloth travel. There is no change in reed movement. The resulting pile height is substantially proportional to cloth travel. The breast beam 6, temple 128 and whip roll 4 draw the ground warp 7 back to the beating-up station towards full beating up but the light pile whip roll 117 cannot simultaneously withdraw the pile warp 8. The ground warp 7 and pile warp 8 must then be advanced together rapidly as far as the next partial beating-up by the amount of cloth travel which corresponds to a required pile height. To this end, the two whip rolls 4, 117 must detension the corresponding warps 7, 8 just as rapidly and simultaneously ensure the necessary warp tension values. This rapid warp advance over an accurately defined cloth travel of e.g. 20 mm takes place in less than one weaving cycle T. The result is conflicting requirements for each of the two warp tensions in the various sub-zones of the cycles or repeats (fabric advance after full beating-up, fabric withdrawal before full beating-up and, in between, normal warp let-off speed) if appropriate warp-tensioning pulses are to produce optimal weaving properties and cloth qualities.

Conventional sprung whip roll systems cannot satisfactorily meet these conflicting requirements for ground warp tension and pile warp tension. However, the construction according to the invention of FIG. 7 can substantially fulfill these requirements. To this end, an individual servomotor drives each of the terry-towel elements 4, 6 separately. The servomotor 36 drives the breast beam 6 by way of a lever 131 having a pivot 132 and toothing 136 and a separately triggered servomotor 37 operates the whip roll 4 by way of a lever 140. In this construction, warp forces 137, 138 are preferably taken up by biasing springs 141, 142 acting on the levers 131, 140, the springs 111, 142 being so adjusted that average warp force values for average cloth travel are exactly compensated for by the forces of the springs. Shed compensation is also included in the triggering of the whip roll 4. The breast beam 6 or the whip roll 4 can be driven either laterally at one end or centrally by way of the levers 131, 140. A central drive helps to obviate asymmetrical twisting which can cause asymmetrical formation of the cloth and pile. However, an advantageous and even more effective construction can have the servomotors 38*a*, 38*b* disposed on each side upright of a loom with each synchronously driving by way of a lever the breast beam 6 and whip roll 4 respectively. In this event, the two servomotors 38*a*, 38*b* can be operate by just a single motor controller 76 and power pack 77. Also, the pile whip roll 117 can be triggered as a secondary pile-forming element, as described with reference to FIG. 5, by another independent servomotor of the cloth or terry-towelling control 74.

Servocontrol of warp tensions is also of use in a loom having an effects beam instead of the pile warp beam 2 of the loom of FIG. 7.

FIG. 8 shows an example comprising a warp-tensioning element driven in a constant basic movement by the main motor of the loom, the basic movement being freely modulated by a servomotor. A whip roll 4 is rotatably mounted on a single-armed lever 146 whose other end has toothing 32. A central pivot 147 of lever 146 is fixedly mounted in the loom frame. The servomotor 36 acts, by way of a worm 33 and the toothing 32, lever 146 and lever 144 to move the whip roll 44. By way of a connecting rod 148 and an eccentric 149, the bottom end of the lever 144 is connected to main motor shaft 13 of the loom. The whip roll 4 is therefore driven automatically in a fixed cyclic basic movement 150. This can correspond approximately to a constant shed compensation. Actual optimization of warp tension and the adaptation thereof to a change in weave are then effected by the free modulation on an individual pick basis which the servomotor 36 imparts to the top end of the lever 144.

The invention thus provides a method and corresponding loom which open up new perspectives for weaving which conventional looms cannot provide.

The invention also provides a method whereby free modulation of the warp tension patterns may be readily performed. Further, changes in the modulation of the warp tension patterns may be automated so as to enlarge the patterning possibilities of the loom.

What is claimed is:

1. A loom comprising at least one warp-tensioning element for moving into a path of warp yarns extending to and forming at least a top shed to deflect the warp yarns therefrom into a tensioned state;

a servomotor;

transmission means coupling said servomotor to said element for movement of said element into said path in response to selective operation of said servomotor; and a circuit arrangement having a control connected to said servomotor for driving said servomotor to effect movement of said element and a control input connected to said control to deliver programmable signals to said control for actuating said servomotor to adjust the tension in said yarns of said top shed within a predetermined range.

2. A loom as set forth in claim 1 wherein said servomotor has a rotor of low mass movement of inertia and high field strength permanent magnets.

3. A loom as set forth in claim 2 wherein said magnets are rare earth magnets.

4. A loom as set forth in claim 2 wherein said magnets are made of Nd-Fe-B compounds.

5. A loom as set forth in claim 2 wherein said servomotor has a stator and means for cooling said stator.

6. A loom as set forth in claim 1 wherein said transmission means is a reduction transmission having a low inertia primary element connected to a shaft of said servomotor.

7. A loom as set forth in claim 1 which further comprises at least one measurement input, at least one data input and a computer unit connected to said circuit arrangement to provide two-way communication with the loom.

8. A loom as set forth in claim 1 which further comprises a pair of said elements for movement into the respective paths of separate sheets of warp yarns, and a pair of servomotors, each servomotor being connected to a respective element for independent operation from the other servomotor.

9. A loom as set forth in claim 1 further comprising a pair of said warp tensioning elements, a pair of servomotors, each said servomotor being connected to a respective element for driving thereof, and a single control connected to said servomotors for actuating said servomotors in synchronism.

10. A loom as set forth in claim 1 further comprising at least one pile-forming element and a second servomotor for driving said pile-forming element.

11. A loom comprising a warp tensioning element for moving into a path of warp yarns upstream of a shed of the warp yarns relative to yarn movement to deflect the warp yarns into a tensioned state;

a servomotor for deriving said element;

means coupling said servomotor to said element for movement of said element into said path;

a detector for detecting the tension in the warp yarns upstream of the shed and generating a signal in response thereto; and a tension control for receiving said signal for actuating said servomotor in a periodic manner adapted to loom cycles to adjust the tension in the warp yarns into a predetermined range.

12. A loom as set forth in claim 11 which further comprises a control input connected between and to said detector and said tension control for triggering said tension control in a series of predetermined programmable pulses.

13. A loom as set forth in claim 11 wherein said means is a reduction transmission.

14. A loom as set forth in claim 11 which further comprises a computer connected between and to said detector and said tension control to deliver a programmed sequence of pulse to said control in response to signals from said detector to actuate said servomotor in response thereto.

15. A method of controlling warp tension in a loom comprising the steps of passing a plurality of warp yarns through a predetermined path from a warp beam to a cloth beam in a loom;

shedding the warp yarns between the warp beam and cloth beam into a top shed and a bottom shed during at least one cycle of the loom while increasing the tension in at least the yarns forming the top shed between the warp beam and the cloth beam;

detecting the tension in at least the yarns forming the top shed at a location upstream of the sheds relative to the movement of the yarns; and selectively deflecting at least the yarns forming the top shed from said path at a location upstream of the shed during said loom cycle in dependence on the detected tension to adjust the tension in the top shed into a predetermined range.

16. A method as set forth in claim 15 wherein said selective deflecting of the yarns is performed independently of said shedding of the yarns during said loom cycle.

17. A method as set forth in claim 15 wherein said deflecting of the yarns forming the top shed occurs in a first sub-zone of said loom cycle to reduce the tension in said yarns below an adjustable maximum set value and in a second sub-zone of said loom cycle to increase the tension in said yarns above an adjustable minimum set value.

18. A method as set forth in claim 15 which further comprises the steps of passing a plurality of pile warp yarns into said path to the cloth beam for shedding into at least one of said sheds;

cyclically deflecting the pile warp yarns upstream of said sheds during said loom cycle to form a pile of said pile warp yarns in a produced cloth; and superimposing a selective deflection on the pile warp yarns in dependence on the detected tension to adjust the tension in said pile warp yarns.

19. A method of operating a loom comprising the steps of passing a plurality of warp yarns through a predetermined path form a warp beam to a cloth beam;

shedding the warp yarns between the warp beam and the cloth beam into a top shed and a bottom shed during at least one loom cycle while increasing the tension in at least the yarns forming the top shed;

detecting the tension in at least the yarns forming the top shed in said path upstream of the top shed relative to the movement of the yarns; and directing a deflecting element into said path to deflect at least the yarns forming said top shed in response to the detected tension to adjust the tension in the yarns forming the top shed into a predetermined range.

20. A method as set forth in claim 19 which further comprises the step of driving the deflecting element in a selectively variable manner during said loom cycle in response to a control pulse generated in dependence on the detected tension.

21. A method as set forth in claim 19 which further comprises the steps of operating a first drive control in cyclic manner to effect said shedding of the warp yarns and operating a second drive control independently of the first control to effect the selective deflection of the deflecting element.

22. A method as set forth in claim 21 wherein said second drive control is triggered during said loom cycle by a sequence of pulses having at least different amplitudes, widths and phase relationships from each other to vary the tension in the warp yarns.

23. A method of operating a loom comprising the steps of passing a plurality of warp yarns through a predetermined path from a warp beam to a cloth beam;

shedding the warp yarns between the warp beam and the cloth beam into a top shed and a bottom shed during at least one loom cycle while increasing the tension in at least the yarns forming the top shed;

detecting the tension in the warp yarns upstream of the sheds relative to the movement of the yarns; and deflecting all the yarns from said path in response to the detected tension to adjust the tension in the yarns into a predetermined range during said shedding step.

24. A method as set forth in claim 23 wherein the deflection of the yarns is modulated in a pulsed pattern to reduce tension peaks in the yarn of at least said top shed during shedding into said predetermined range during each loom cycle.

25. A loom comprising a warp beam for delivering warp yarns into a predetermined yarn path;

a cloth beam for receiving cloth;

a whip roll in said path downstream of said warp beam relative to the direction of warp movement for maintaining tension in the warp yarns;

heald frames in said path for shedding the warp yarns into a top shed and a bottom shed for formation of a cloth;

a tension detector in said path for detecting the tension in the warps during shedding and generating a signal in response thereto; and a warp tensioning control for varying the tension in the yarns during shedding in response to said signal to adjust the tension in the yarns into a predetermined range during shedding.

26. A method as set forth in claim 25 wherein said control includes a roller in said path having the warp yarns deflected thereover, a servomotor for moving said roller relative to said path in response to said signal and a transmission connecting said servomotor to said roller to move said roller to vary the tension in the warp yarns.

* * * * *

UNITED STATES PATENT AND TRADEMARK OFFICE

CERTIFICATE OF CORRECTION

PATENT NO. : 5,014,756

DATED : May 14, 1991

INVENTOR(S) : RUDOLF VOGEL, et al

It is certified that error appears in the above-identified patent and that said Letters Patent is hereby corrected as shown below:

Column 1, line 12 change 'tungswebmachinen" to -tungswebmaschinen-
Column 1, line 26 change "staring" to -starting-
Column 4, line 4 change "therefore" to -therefor-
Column 4, line 13 change "via" to -via the-
Column 4, line 14 change "32" to -52-
Column 4, line 31 change "and is supported in" to -The pinion 63-
Column 4, line 64 change "form" to -from-
Column 6, line 21 change "corresponding" to -correspondingly-
Column 6, line 23 change ") To" to -). To-
Column 6, line 43 cahnge "Controlled" to -controlled-
Column 8, line 48 change "operate" to -operated-
Column 9, line 35 change "movement" to -moment-
Column 10, line 25 change "pulse" to -pulses-
Column 11, line 4 change "form" to -from-

Signed and Sealed this

Nineteenth Day of January, 1993

*Attest:*

*Attesting Officer*

DOUGLAS B. COMER

*Acting Commissioner of Patents and Trademarks*